US009070976B2

(12) United States Patent
Gapski et al.

(10) Patent No.: US 9,070,976 B2
(45) Date of Patent: Jun. 30, 2015

(54) ANTENNA APPARATUS FOR RADIO-BASED ELECTRONIC DEVICES

(75) Inventors: Dietmar Gapski, Bocholt (DE); Oliver Spiess, Bocholt (DE)

(73) Assignee: Gigaset Communications GmbH, München (DE)

( * ) Notice: Subject to any disclaimer, the term of this patent is extended or adjusted under 35 U.S.C. 154(b) by 1032 days.

(21) Appl. No.: 12/808,950

(22) PCT Filed: Dec. 1, 2008

(86) PCT No.: PCT/EP2008/066504

§ 371 (c)(1),
(2), (4) Date: Jul. 7, 2010

(87) PCT Pub. No.: WO2009/080445

PCT Pub. Date: Jul. 2, 2009

(65) Prior Publication Data

US 2011/0199268 A1 Aug. 18, 2011

(30) Foreign Application Priority Data

Dec. 21, 2007 (DE) ..... 10 2007 062 051

(51) Int. Cl.
*H01Q 1/24* (2006.01)
*H01Q 9/36* (2006.01)
(Continued)

(52) U.S. Cl.
CPC ..... *H01Q 1/243* (2013.01); *H01Q 9/36* (2013.01); *H01Q 9/40* (2013.01); *H01Q 9/42* (2013.01)

(58) Field of Classification Search
CPC ..... H01Q 9/30
USPC ..... 343/702, 700 MS, 789
See application file for complete search history.

(56) References Cited

U.S. PATENT DOCUMENTS 4,123,756 A 10/1978 Nagata et al.
4,975,711 A 12/1990 Lee
(Continued)

FOREIGN PATENT DOCUMENTS

DE 38 40 180 4/1990
DE 10 2007 006 463 9/2007
(Continued)

OTHER PUBLICATIONS

Article from http://de.wikipedia.org entitled "Resonator", 1 page, believed to be dated Sep. 23, 2007, together with English language version from www.wikipedia.org.
(Continued)

*Primary Examiner* — Hoang V Nguyen
*Assistant Examiner* — Hai Tran
(74) *Attorney, Agent, or Firm* — Harness, Dickey & Pierce, P.L.C.

(57) ABSTRACT

An antenna apparatus is proposed, which can be operated outside in the vicinity around the antenna apparatus despite a shielding effect of an electrically conducting frame or electrically conducting housing. In the process, the electrically conducting frame or electrically conducting housing encloses a housing volume inside the housing, within said volume an electrically conducting connection being produced from a first to a second location of the electrically conducting frame or the electrically conducting housing. The first and the second locations are selected such that a radio resonance chamber is separated by a parallel radio resonance at a working frequency of the electronic device inside the enclosed housing volume by means of the electrically conducting connection.

10 Claims, 2 Drawing Sheets

(51) Int. Cl.
*H01Q 9/40* (2006.01)
*H01Q 9/42* (2006.01)

(56) References Cited

U.S. PATENT DOCUMENTS

| | | | | |
|---|---|---|---|---|
| 5,394,160 | A * | 2/1995 | Iwasaki et al. | 343/702 |
| 6,463,308 | B1 * | 10/2002 | Wikborg et al. | 505/210 |
| 6,538,618 | B2 | 3/2003 | Yamamoto et al. | |
| 6,879,293 | B2 | 4/2005 | Sato | |
| 6,906,677 | B2 * | 6/2005 | Yamamoto et al. | 343/789 |
| 2001/0047861 | A1 * | 12/2001 | Maeda et al. | 165/167 |
| 2002/0044099 | A1 | 4/2002 | Yamamoto et al. | |
| 2002/0047805 | A1 | 4/2002 | Yamamoto et al. | |
| 2002/0135522 | A1 | 9/2002 | Yamamoto et al. | |
| 2005/0017910 | A1 | 1/2005 | Park | |
| 2007/0229366 | A1 * | 10/2007 | Kim et al. | 343/700 MS |

FOREIGN PATENT DOCUMENTS

| | | | |
|---|---|---|---|
| EP | 0 646 986 | | 4/1995 |
| EP | 1158604 | A2 | 11/2001 |
| EP | 1198028 | A1 | 4/2002 |
| EP | 1227538 | A1 | 7/2002 |
| EP | 1 443 677 | | 8/2004 |

OTHER PUBLICATIONS

Article from http://de.wikipedia.org entitled "Klystron", 2 pages, believed to be dated Aug. 21, 2007, together with English language version from www.wikipedia.org.

Article from http://de.wikipedia.org entitled "Cavity ring-down spectroscopyesonator", 3 pages, believed to be dated Apr. 3, 2007, together with English language version from www.wikipedia.org.

* cited by examiner

ANTENNA APPARATUS FOR RADIO-BASED ELECTRONIC DEVICES

CROSS-REFERENCE TO RELATED APPLICATIONS

This application is a National Stage of International Application PCT/EP2008/066504, filed Dec. 1, 2008. This application claims benefit and priority of German application 10 2007 062 051.0 filed Dec. 21, 2007. The entire disclosures of the above applications are incorporated herein by reference.

BACKGROUND

This section provides background information related to the present disclosure which is not necessarily prior art.

1. Technical Field

The invention relates to an antenna apparatus.

2. Discussion

It is known to manufacture the housings of wireless electronic devices, for example mobile communication terminals or communication terminals which are to be used in a mobile capacity, as a plastic part.

When metal-coated or metallic housings, or housings which are at least partially metal-coated or metallic, are used, the problem arises that an antenna apparatus which is placed inside the housing experiences a shielding effect.

SUMMARY OF THE INVENTION

An object of the present invention is to provide an antenna apparatus of the aforementioned type which is functional in the vicinity outside the antenna apparatus despite a shielding effect of an electrically conductive frame or an electrically conductive housing.

Accordingly, it is preferable for a housing to have a lateral surface which includes at least one section that is metal-coated or metallic and which encloses an inner volume of the housing. An electrically conductive connection from a first to a second location of the respective metal-coated or metallic lateral surface is established within the enclosed housing volume. The first and second locations are selected in such a way that a wireless resonance chamber is partitioned inside the enclosed housing volume as a result of the electrically conductive connection between the first and the second location, the wireless resonance chamber having a wireless parallel radio resonance which is matched to a working frequency of a basic electronic device.

Such an antenna apparatus has the advantage that it may be used even when, or specifically because, the lateral surface of the housing of an affected wireless electronic device has an at least partially metal-coated or metallic design.

Accordingly, the partitioned resonance chamber between the above-referenced first and second locations has a wireless path length which is adjusted to one-half the wavelength of the working frequency of the basic wireless electronic device.

This adjustment is important for obtaining the desired parallel resonance in the affected resonance chamber.

The high-frequency energy to be emitted or received via the antenna apparatus may advantageously be respectively injected into or extracted from the referenced partitioned resonance chamber using customary galvanic, inductive, or capacitive techniques.

The electrically conductive connection between the first and the second location may advantageously be easily achieved using a conductor provided specifically for this purpose, or by means of an electrically conductive surface of a printed circuit board.

In addition, it is also advantageous that the antenna apparatus may be manufactured as a component of a wireless electronic device which is a wireless communication terminal.

Lastly, wireless electronic devices with completely new designs may be produced using the antenna apparatus.

BRIEF DESCRIPTION OF THE DRAWINGS

The drawings described herein are for illustrative purposes only of selected embodiments and not all possible implementations, and are not intended to limit the scope of the present disclosure.

The invention is explained in greater detail below with reference to the figures, which show the following.

Corresponding reference numbers indicate corresponding parts throughout the several views of the drawings.

DETAILED DESCRIPTION OF THE PREFERRED EMBODIMENTS

Figure 1:
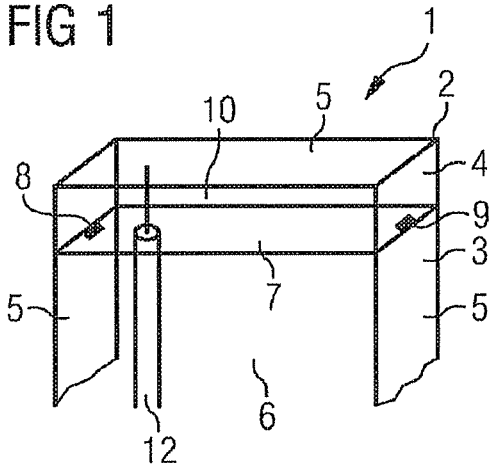
FIG. 1 shows a first exemplary embodiment of the invention in a schematic, three-dimensional illustration.
Figure 2:
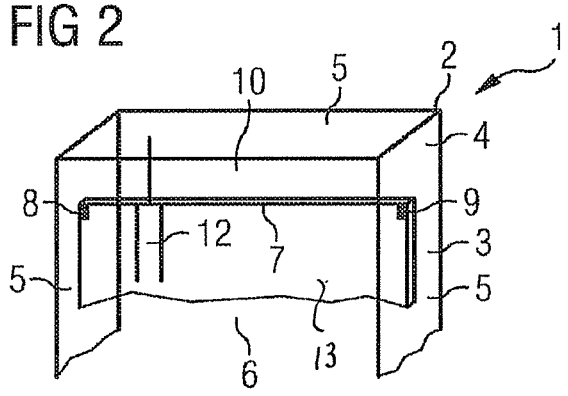
FIG. 2 shows a second exemplary embodiment of the invention in a schematic, three-dimensional illustration.

Example embodiments will now be described more fully with reference to the accompanying drawings.

FIGS. 1 through 5 each show a wireless electronic communication terminal 1, with a view of the interior of the communication terminal 1 with regard to the invention.

In all the illustrations according to FIGS. 1 through 5, the communication terminal 1 has a housing 2 which includes a lateral surface 3 that is metallic or metal-coated at least in one section 4. However, in each of the present exemplary embodiments according to FIGS. 1 through 5 the entire lateral surface 3 of the housing 2 is shown as being metallic or metal-coated.

If a metal coating is present, this metal coating may be achieved by chrome plating, for example. If a metallic design is present, the affected section or partial section of the housing 2 is designed as solid metal, for example a metal die-cast part.

The metal-coated or solid metal housing 2 forms an electrically conductive frame 5 which encloses an inner housing volume 6 of the device 1.

Inside the enclosed housing volume 6, an electrically conductive connection 7 is established through the enclosed housing volume 6, from a first to a second location 8, 9 on the respective metal-coated or metallic lateral surface 3.

The referenced first and second locations 8, 9 are both selected in such a way that within the enclosed housing volume 6, a wireless resonance chamber 10 having a wireless parallel resonance at a working frequency of the electronic device 1 is partitioned as a result of the electrically conductive connection 7.

For this purpose, the partitioned resonance chamber 10 between the first and the second location 8, 9 has a wireless path length 11 (shown only in FIGS. 3 through 5 for simplicity) which corresponds to one-half the wavelength of the working frequency of the device 1.

Each of FIGS. 1 through 5 schematically shows an attachment of an antenna cable 12 with regard to the respective partitioned resonance chamber 10.

Figure 3:
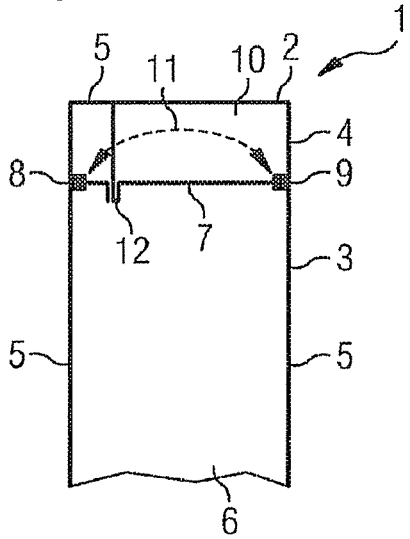
FIG. 3 shows a first attachment example for an antenna cable for an article according to FIG. 1.
Figure 4:
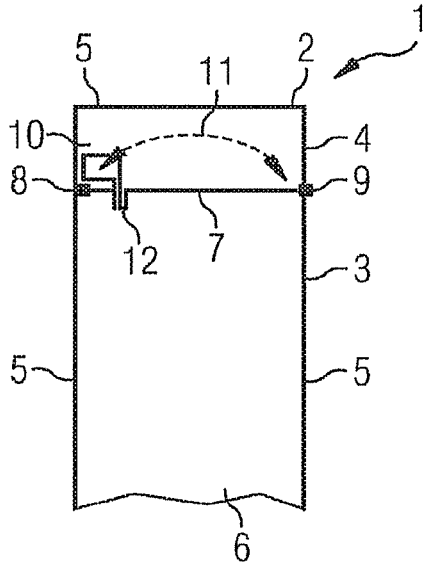
FIG. 4 shows a second attachment example for an antenna cable for an article according to FIG. 1.
Figure 5:
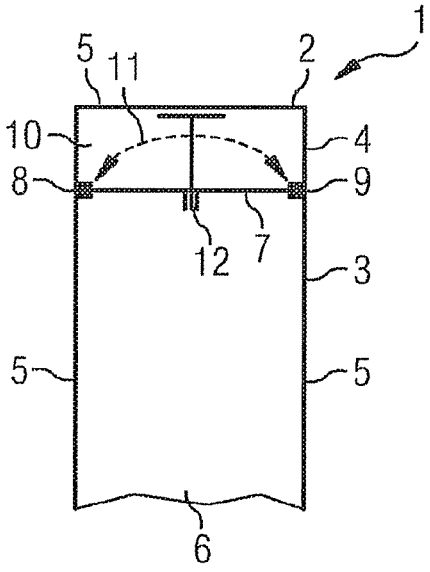
FIG. 5 shows a third attachment example for an antenna cable for an article according to FIG. 1.

In particular, FIG. 3 shows an attachment option of a galvanic type, FIG. 4 shows an attachment option of an inductive type, and FIG. 5 shows an attachment option of a capacitive type.

The electrically conductive connection 7 between the referenced first and second locations 8, 9 may be achieved using a conductor designed specifically for this purpose (FIGS. 1 and 3 through 5), or by means of an electrically conductive surface (FIG. 2) of a printed circuit board 13.

The surface in question may, for example, be a copper layer of the printed circuit board 13.

The specialized conductor may be a wire or strip.

With the aid of the referenced attachment options for antenna cable 12, by using the antenna apparatus which is specially formed using the above-described measures it is possible for high-frequency energy which is to be emitted to be injected into, or high-frequency energy which is to be received to be extracted from, the partitioned resonance chamber (10) by use of galvanic, inductive, or capacitive means.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A wireless radio communication terminal comprising:

a housing;

the housing having a surface with a metallic or metal coated lateral section;

an electrically conductive connection making a first and a second electrically conductive contact at first and second different locations, respectively, of the lateral section;

a radio resonance cavity;

a printed circuit board;

wherein the radio resonance cavity is delimited by a subsection of the housing having a surface with a metallic or metal coated lateral section, at least a portion of the lateral section and by the electrically conductive connection;

wherein the electrically conductive connection which delimits the radio resonance cavity is an electrically conductive surface of the printed circuit board;

in such a way that the electrically conductive surface of the printed circuit board is forming the radio resonance cavity by making said electrically conductive contact at said two locations of the lateral section, allowing a current to flow from the lateral section through the first contact at a first of said two locations, through the electrically conductive surface of the printed circuit board, and through the second contact at a second of said two locations into the lateral section, the radio resonance cavity being a conductor-free space in which a standing electromagnetic radio wave may be formed between the portions of the lateral section at the first and second locations;

in such a way that parallel resonance is formed at a working frequency of the wireless radio communication terminal;

wherein the radio resonance cavity, has a radio wavelength between the first and second locations which is adjusted to one-half the wavelength of the working frequency of the wireless radio communication terminal; and wherein high-frequency energy to be emitted be injected into the radio resonance cavity, or high-frequency energy to be received may be extracted from the radio resonance cavity, by antenna feeding means.

2. The wireless radio communication terminal according to claim 1, wherein the first and second locations are oppositely situated.

3. The wireless radio communication terminal according to claim 1, wherein an antenna cable is attached to the radio resonance cavity in such a way that the high-frequency energy to be emitted or received is respectively injected or extracted by attaching the antenna cable or by use of galvanic, inductive, or capacitive means.

4. The wireless radio communication terminal according to claim 1, wherein the metallic or metal coated lateral section is part of an electrically conductive housing frame that completely or almost completely encloses the wireless radio communication terminal.

5. The wireless radio communication terminal according claim 1, wherein the metallic or metallic coated lateral section of the housing is of solid metal.

6. The wireless radio communication terminal according to claim 1, wherein the metallic or metallic coated lateral section of the housing is achieved by chrome plating.

7. A wireless radio communication terminal for a device having a working frequency, the terminal comprising:

a housing having a top and sides defining an internal volume;

at least an upper portion of the sides being metallic or metal coated;

a printed circuit board having an electrically conductive surface;

the printed circuit board being mounted in the internal volume so that edges of the electrically conductive surface are electrically connected at first and second locations to opposite surfaces of the sides of the housing thereby defining a subsection of the housing that is configured as a radio resonance cavity, in such a way that a current is allowed to flow from the housing to the electrically conductive surface at the first location, through the electrically conductive surface of the printed circuit board, and from the electrically conductive surface into the housing at the second location, wherein the radio resonance cavity is conductor-free;

the electrically conductive surface of the printed circuit board having a wireless path length that substantially corresponds to one-half of a wavelength of the working frequency of the device; and wherein high-frequency energy to be emitted may be injected into the radio resonance cavity, or high-frequency energy to be received may be extracted from the radio resonance cavity.

8. A wireless radio communication terminal communicating using a working frequency, the terminal comprising:

a housing having a top and sides defining an internal volume; and a printed circuit board, wherein:

the printed circuit board is disposed to partition the housing into an enclosed space and a radio resonance cavity, the printed circuit board extends to the sides of the housing such that no openings exist in the ,printed circuit board between the enclosed space and the radio resonance cavity, the radio resonance cavity has a resonance at the working frequency, a first surface of the printed circuit board includes a conductive portion, the first surface of the printed circuit board faces the radio resonance cavity, the first surface of the printed circuit board has a wireless path length that substantially corresponds to one-half of a wavelength of the working frequency, sections of the sides of the housing surround the radio resonance cavity, at least a portion of the sections of the sides of the housing are conductive, a first end of the conductive portion of the printed circuit board is electrically connected to the conductive portion of the sections of the sides of the housing at a first location, a second end of the conductive portion of the printed circuit board is electrically connected to the conductive portion of the sections of the sides of the housing at a second location, energy to be emitted from the terminal is injected into the radio resonance cavity, and energy to be received at the terminal is extracted from the radio resonance cavity.

9. The wireless radio communication terminal of claim 8 wherein the conductive portion of the sections of the sides of the housing is metallic or metal-coated.

10. The wireless radio communication terminal of claim 8 further comprising an antenna cable attached to the radio resonance cavity.

* * * * *